US007497704B2

(12) United States Patent
Saito et al.

(10) Patent No.: US 7,497,704 B2
(45) Date of Patent: Mar. 3, 2009

(54) ELECTRICAL CONNECTOR CAPABLE OF SUPPRESSING CROSSTALK

(75) Inventors: Yuichi Saito, Tokyo (JP); Masahiro Yoshino, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/522,034

(22) Filed: Sep. 15, 2006

(65) Prior Publication Data

US 2007/0066115 A1 Mar. 22, 2007

(30) Foreign Application Priority Data

Sep. 16, 2005 (JP) ..... 2005-270336

(51) Int. Cl.
*H01R 13/648* (2006.01)

(52) U.S. Cl. ..... 439/108; 439/608

(58) Field of Classification Search ..... 439/260, 439/607, 608

See application file for complete search history.

(56) References Cited

U.S. PATENT DOCUMENTS

| | | | | |
|---|---|---|---|---|
| 6,350,134 | B1 * | 2/2002 | Fogg et al. | 439/79 |
| 6,457,983 | B1 * | 10/2002 | Bassler et al. | 439/607 |
| 6,540,559 | B1 * | 4/2003 | Kemmick et al. | 439/608 |
| 6,953,351 | B2 * | 10/2005 | Fromm et al. | 439/607 |
| 7,156,672 | B2 | 1/2007 | Fromm et al. | |

FOREIGN PATENT DOCUMENTS

| | | |
|---|---|---|
| CN | 1643742 | 7/2005 |
| CN | 1656652 | 8/2005 |
| JP | 06-029047 | 5/1999 |
| JP | 2000-286019 | 10/2000 |
| JP | 2001-345151 | 12/2001 |
| JP | 2002334748 | 11/2002 |
| JP | 2004-192939 | 7/2004 |
| JP | 2005-531121 | 10/2005 |
| WO | WO 2004/001907 | 12/2003 |

OTHER PUBLICATIONS

Chinese Office Action and translation.
Japanese Office Action dated May 14, 2008.
Japanese Office Action dated Aug. 13, 2008.

* cited by examiner

*Primary Examiner*—Briggitte R Hammond
(74) *Attorney, Agent, or Firm*—Collard & Roe, P.C.

(57) ABSTRACT

In a connector to be mounted to a substrate, each of contacts has a contacting portion to be connected to a mating connector and a terminal portion to be connected to the substrate. The contacts include a contact group of a pair of signal contacts and a ground contact. The contacting portions of the paired signal contacts are disposed in a first row with a first interval kept from one another. The contacting portion of the ground contact is disposed in a second row parallel to the first row to be faced to the first interval. The terminal portions of the paired signal contacts are disposed in a third row to be adjacent to each other. The terminal portion of the ground contact is disposed in the third row to be adjacent to one of the terminal portions of the paired signal contacts.

13 Claims, 3 Drawing Sheets

ELECTRICAL CONNECTOR CAPABLE OF SUPPRESSING CROSSTALK

This application claims priority to prior Japanese patent application JP 2005-270336, the disclosure of which is incorporated herein by reference.

BACKGROUND OF THE INVENTION

This invention relates to a connector and, in particular, to an electrical connector suitable for use in, for example, high-speed differential transmission.

For example, an electrical connector of the type is disclosed in Japanese Patent (JP-B) No. 3564555. The electrical connector comprises a plurality of contact groups each of which includes a pair of signal contacts and a ground contact, and is surface-mounted to a substrate. Each of the contacts has a contacting portion to be contacted with a mating connector and a terminal portion to be connected to the substrate.

In the Japanese Patent (JP-B) No. 3564555, the contacting portions are arranged in two rows. Further, the signal contacts in every two adjacent contact groups are disposed in rows different from each other. In other words, the signal contacts in one contact group are disposed in one of the rows while the signal contacts in another contact group adjacent to the one contact group are disposed in the other row. As a result, the signal contacts in every two adjacent contact groups are relatively distant from each other. Accordingly, there is no risk of degradation of electrical performance due to crosstalk.

On the other hand, the terminal portions are arranged in a single row. In each contact group, the ground contact is disposed between the paired signal contacts. As a result, the signal contacts in every two adjacent contact groups are disposed adjacent to each other. Accordingly, there is a risk of degradation of electrical performance due to crosstalk between every two adjacent contact groups.

SUMMARY OF THE INVENTION

It is therefore an object of this invention to provide a connector capable of decreasing crosstalk between adjacent contact groups so that electrical performance is improved.

Other objects of the present invention will become clear as the description proceeds.

According to a first aspect of the present invention, there is provided a connector to be mounted to a substrate, comprising a plurality of contacts each of which has a contacting portion to be connected to a mating connector and a terminal portion to be connected to the substrate, wherein the contacts includes a first contact group comprising a pair of signal contacts and a ground contact, the contacting portions of the paired signal contacts are disposed in a first row with a first interval kept from one another, the contacting portion of the ground contact is disposed in a second row parallel to the first row to be faced to the first interval, the terminal portions of the paired signal contacts are disposed in a third row to be adjacent to each other, and the terminal portion of the ground contact is disposed in the third row to be adjacent to one of the terminal portions of the paired signal contacts.

According to a second aspect of the present invention, there is provided a connector to be mounted to a substrate. The connector comprises a plurality of contacts each of which has a contacting portion to be connected to a mating connector and a terminal portion to be connected to the substrate, and a housing having a coupling portion to be coupled with the mating connector and holding the contacts, the contacts including a plurality of pairs of signal contacts and a plurality of ground contacts, the paired signal contacts and the ground contacts being alternately arranged, the contacts being arranged in two rows in a staggered or zigzag pattern at the contacting portions and arranged in a single row at the terminal portions, the contacting portions being arranged so that each pair of signal contacts and each ground contact are positioned at three vertexes of a triangle in the coupling portion, respectively, the terminal portions being arranged so that the paired signal contacts whose contacting portions are arranged in one of the two rows, the ground contact whose contacting portion is arranged in the other row, the paired signal contacts whose contacting portions are arranged in the other row, and the ground contact whose contacting portion is arranged in the one row are alternately arranged.

According to a third aspect of the present invention, there is provided a connector comprising a plurality of contacts each of which has a contacting portion to be connected to a mating connector and a terminal portion to be connected to the substrate, and a housing holding the contacts, the contacts including a plurality of pairs of signal contacts and a plurality of ground contacts, the contacting portions being arranged in two rows in a staggered or zigzag pattern and arranged so that each pair of signal contacts and each ground contact are positioned at three vertexes of a triangle in the coupling portion, respectively, the terminal portions being arranged in a single row and arranged so that the ground contact is positioned adjacent to the paired signal contacts at one side of the paired signal contacts.

According to a fourth aspect of the present invention, there is provided a connector to be mounted to a substrate. The connector comprises a plurality of contacts each of which has a contacting portion to be connected to a mating connector and a terminal portion to be connected to the substrate, and a housing holding the contacts and having a coupling portion to be coupled with the mating connector, the contacts including a plurality of pairs of signal contacts and a plurality of ground contacts, the contacts being arranged in two rows in a staggered or zigzag pattern at the contacting portions and arranged in a single row at the terminal portions, the contacting portions of the contacts being arranged so that the paired signal contacts and the ground contact corresponding thereto are positioned at three vertexes of a triangle and that the triangle is adjacent to a next triangle reversed in position, the terminal portions being arranged so that, outside the paired signal contacts whose contacting portions at two vertexes of the triangle are arranged in one of the two rows, the ground contact whose contacting portion at one vertex of the triangle is arranged in the other row is disposed adjacent to the paired signal contacts, next paired signal contacts, whose contacting portions are positioned at two vertexes of the next triangle and disposed adjacent to the ground contact, being disposed adjacent to the signal contacts, a next ground contact, whose contacting portion is positioned at one vertex of the next triangle, being disposed adjacent to the next paired signal contacts.

DESCRIPTION OF THE PREFERRED EMBODIMENT

Figure 1A:
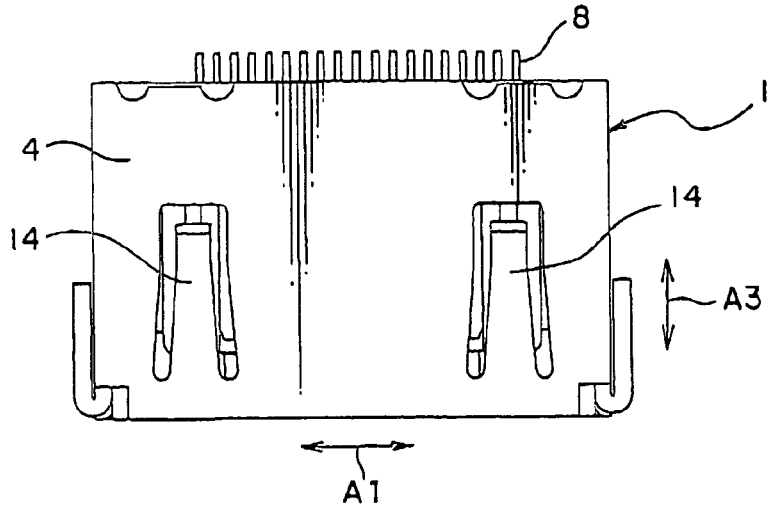
FIG. 1A is a front view of a connector according to one embodiment of this invention.

Referring to FIGS. 1A to 1D, description will be made of a connector according to an embodiment of this invention.

The connector depicted at 1 in the figure is a receptacle connector called an angle type and suitable for use in high-speed differential transmission, and is mounted to a substrate (not shown). The connector 1 comprises a plurality of conductive contacts 2 and a housing 3 holding the contacts 2. The housing 3 comprises a cylindrical conductive shell 4, a block-like main insulator 5 fixed to the shell 4, and a plate-like subsidiary insulator 6 disposed inside the shell 4 and integrally fixed to the main insulator 5. The subsidiary insulator 6 extends in a transversal direction (first direction) A1 and holds the contacts 2 on its opposite surfaces in a vertical direction (second direction) A2. The main insulator 5 and the subsidiary insulator 6 may be integrally formed by an insulating member or may be individually formed by separate insulating members.

Each of the contacts 2 extends along the subsidiary insulator 6 in a back-and-forth direction (third direction) A3. The contact 2 has a contacting portion 7 formed at its front end to be contacted with a mating contact of a mating connector, i.e., a plug connector (not shown) to be connected to the connector 1, a terminal portion 8 formed at its rear end to be connected by soldering or the like to an electrical circuit of the substrate, and a connecting portion 9 formed between the contacting portion 7 and the terminal portion 8. The contacting portion 7, the terminal portion 8, and the connecting portion 9 are integrally formed. The terminal portions are exposed outside the housing 3. The function, the shape, and the arrangement of the contacts 2 will later be described in detail.

The conductive shell 4 surrounds the contacts 2 and the subsidiary insulator 6 with a space left therefrom. The shell 4 has a coupling portion 11 formed at its front part to be coupled to the mating connector.

The conductive shell 4 has a front leg portion 12 and a rear leg portion 13 which are integrally formed at a front part and a rear part of each of its opposite ends in the transversal direction A1, respectively, and which extend downward. These leg portions 12 and 13 serve to electrically connect the conductive shell 4 and the substrate or to position the connector 1, for example, by soldering the leg portions 12 and 13 to through holes of the substrate.

The conductive shell 4 has upper and lower surfaces each of which is provided with two spring members 14. The spring members 14 serve to elastically clamp the mating connector coupled to the connector 1.

Next referring to FIGS. 2 and 3 in addition, description will be made of the arrangement, the shape, and the function of the contacts 2.

The contacts 2 are grouped into a plurality of contact groups each of which includes a pair of signal contacts S and a ground contact G. These contact groups are arranged in a single row in the transversal direction A1. In other words, the paired signal contacts S and the ground contact G are alternately arranged.

Figure 1B:
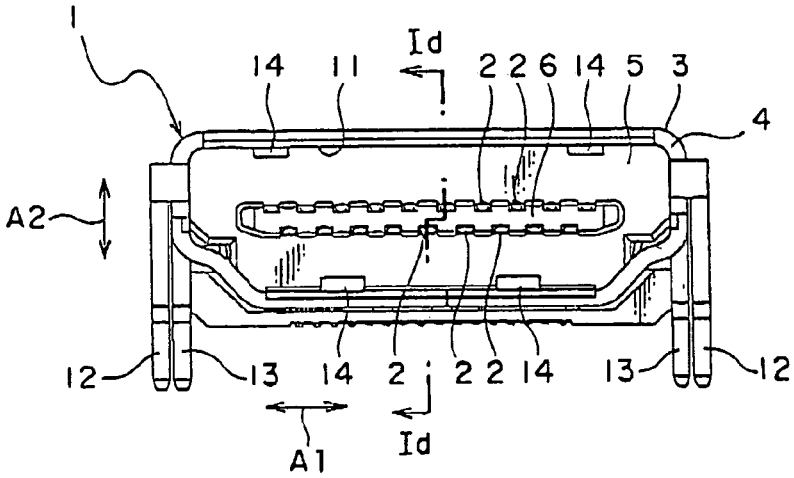
FIG. 1B is a plan view of the connector illustrated in FIG. 1A.
Figure 1C:
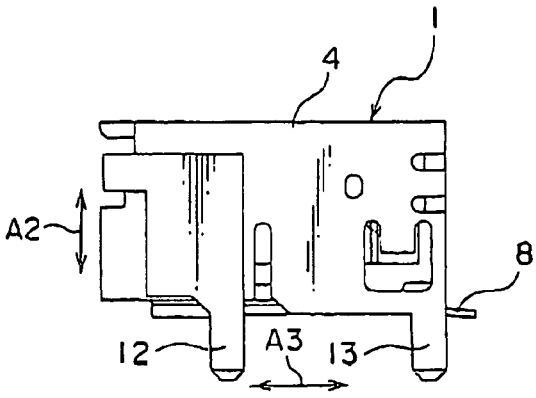
FIG. 1C is a right side view of the connector illustrated in FIG. 1A.
Figure 1D:
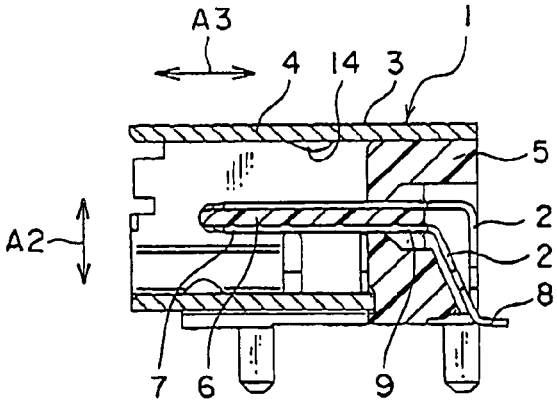
FIG. 1D is a sectional view taken along a line Id-Id in FIG. 1B.
Figure 3:
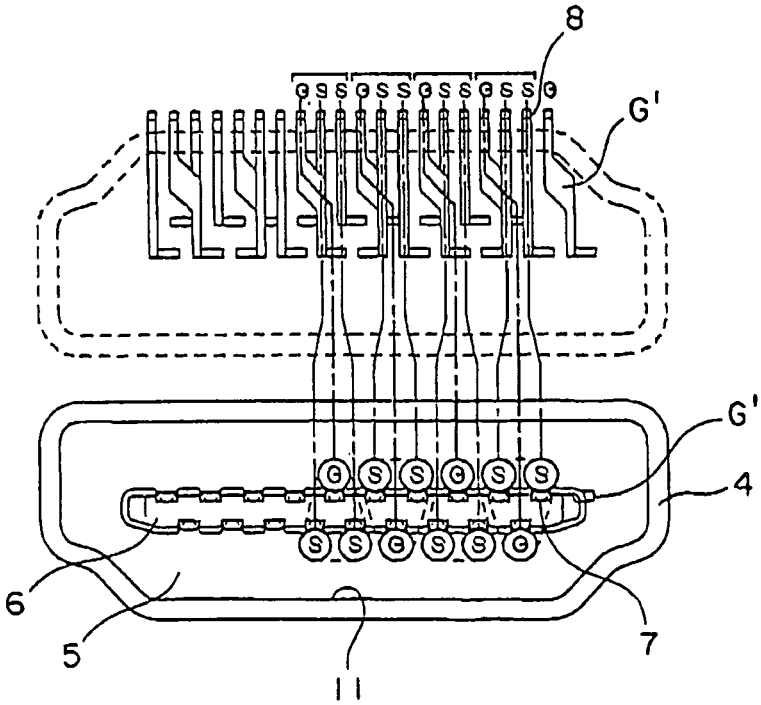
FIG. 3 is a view for describing the arrangement and a function of the contacts used in the connector illustrated in FIGS. 1A to 1D.

As seen from FIG. 1B and a lower part of FIG. 3, the contacting portions 7 of the contacts 2 are arranged in two rows, i.e., an upper row and a lower row, in a staggered or zigzag pattern. In each contact group, the contacting portions 7 of the signal contacts S and the ground contact G are arranged at three vertexes of a triangle, respectively.

More particularly, the description will be made as regards arrangement of the contacting portions 7. In a contact group placed at a right end of FIG. 3, the contacting portions 7 of the signal contacts S are arranged in the upper row while the contacting portion 7 of the ground contact G is arranged in the lower row to confront an intermediate position between the signal contacts S. In a next adjacent contact group, the contacting portions 7 of the signal contacts S are arranged in the lower row while the contacting portion 7 of the ground contact G is arranged in the upper row to confront an intermediate position between the signal contacts S.

The description will be directed to arrangement of the terminal portions 8. As seen from FIGS. 1A, 1D, and 3, the terminal portions 8 of the contacts 2 are arranged in a single row in the transversal direction A1. In the contact group placed at the right end of FIG. 3, the terminal portions 8 of the paired signal contacts S are adjacent to each other and the terminal portion 8 of the ground contact G is adjacent to the paired signal contacts S on one side thereof, i.e., adjacent to the terminal portion 8 of one of the paired signal contacts S. Also in the next adjacent contact group, the terminal portions 8 of the paired signal contacts S are adjacent to each other and the terminal portion 8 of the ground contact G is adjacent to the paired signal contacts S on one side thereof. It is to be noted that the terminal portions 8 of the paired signal contacts S of the next adjacent contact group are adjacent to the terminal portion 8 of the ground contact G of the contact group placed at the right end of FIG. 3.

The above-mentioned arrangement of the contacts 2 will be described in other words. In the coupling portion 11, i.e., at the contacting portions 7, the paired signal contacts S and the ground contact G are positioned at three vertexes of a triangle, respectively, and in one of the rows and the other row, respectively. At the terminal portions 8, the paired signal contacts S whose contacting portions 7 are arranged in one of the rows, the ground contact G whose contacting portion 7 is arranged in the other row, the paired signal contacts S whose contacting portions 7 are arranged in the other row, and the ground contact G whose contacting portion 7 is arranged in the one row are alternately arranged (see FIG. 3). Thus, the contacts 2 are arranged in two rows in a staggered or zigzag fashion in the coupling portion 11, i.e., at the contacting portions 7, and are arranged in a single row at the terminal portions 8. If the contacting portions 7 are arranged at a pitch of 1 mm in each row, the terminal portions 8 collected in a single row are arranged at a pitch of 0.5 mm equal to a half of the pitch of the contacting portions 7.

The contacts 2 whose contacting portions 7 are arranged in the lower row are first press-fitted into the insulators 5 and 6. Then, the contacts 2 whose contacting portions 7 are arranged in the upper row are press-fitted to be positioned above and across the contacts 2 whose contacting portions 7 are arranged in the lower row. Thereafter, the shell 4 is coupled to the insulator 5.

In case where the connector 1 is used in differential signal transmission, the paired signal contacts S are connected to paired signal lines and the ground contact G is connected to a ground line. In unbalanced (single-end) differential signal transmission, "high" and "low" of digital signals are discriminated by a potential difference between the ground line and the signal line. In balanced differential signal transmission, "high" and "low" of digital signals are discriminated by a potential difference between the paired signal lines. In the latter case, the paired signal lines have signal voltages equal in magnitude and different in phase from each other by 180°. In TMDS (Transition Minimized Differential Signaling), data transmission is carried out by the paired signal lines and a single ground line.

With the above-mentioned connector 1, the terminal portions 8 are arranged in a single row and arranged so that the ground contact G is positioned adjacent to the paired signal contacts S on one side thereof. As a result, the signal contacts S in every two adjacent contact groups are not adjacent to each other and the ground contact G is interposed therebetween. Accordingly, it is possible to provide the connector capable of suppressing crosstalk between every two adjacent contact groups and improved in electric performance.

Although the ground contact of each of the contact groups is located at one side of the paired signal contacts of each of the contact groups in the terminal portions 8, the ground contact of a different contact group is disposed at another side of the paired signal contacts in the terminal portions 8. Therefore, impedance performance is not degraded.

Particularly referring to FIG. 2, the arrangement and the shape of the contacts 2 will be described further. On the left side of FIG. 2, the arrangement and the shape of the contacts 2 whose contacting portions 7 are positioned in the lower row in the vertical direction A2 in FIG. 1A are shown. On the right side of FIG. 2, the arrangement and the shape of the contacts 2 whose contacting portions 7 are positioned in the upper row are shown. The positional relationships on the left side and the right side correspond to each other.

Figure 2:
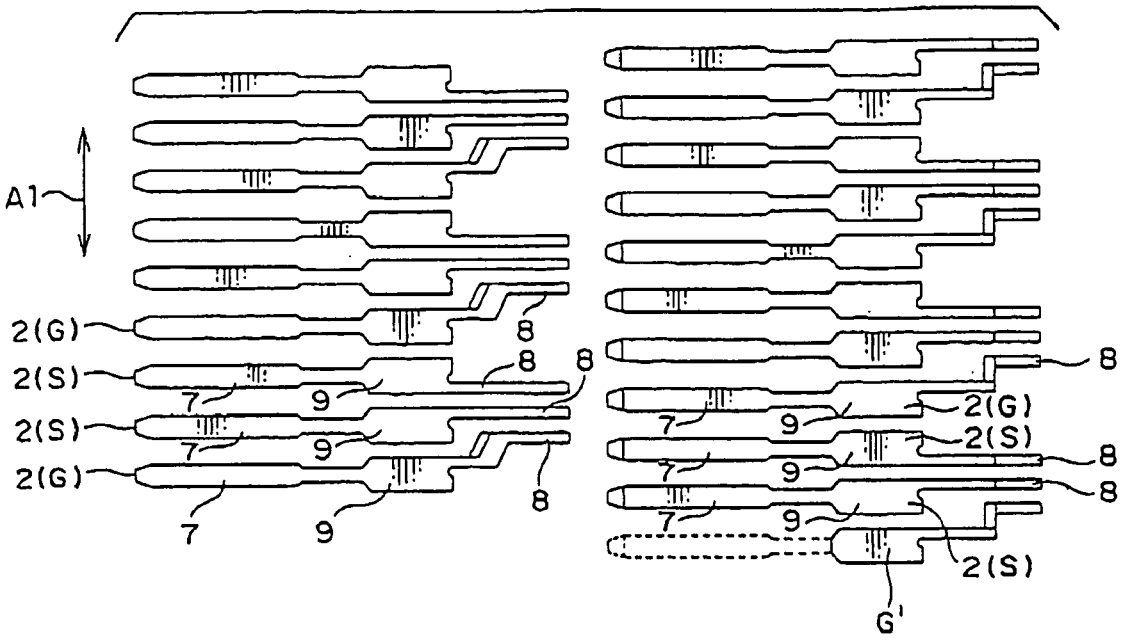
FIG. 2 is a view for describing an arrangement and a shape of contacts used in the connector illustrated in FIGS. 1A to 1D.

As seen from FIG. 2, each of the ground contacts G has a shape such that the terminal portion 8 is substantially shifted in position in the transversal direction A1 with respect to the contacting portion 7. The paired signal contacts S are symmetrical in shape with each other.

In each contact 2, the terminal portion 8 has a width narrower than that of the connecting portion 9. The terminal portions 8 of the paired signal contacts S extend from the connecting portions 9 at positions near to one sides faced to each other.

Figure 4:
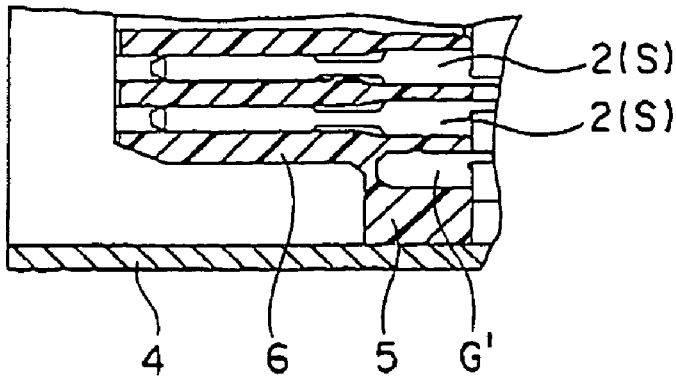
FIG. 4 is a sectional view showing only a part of the connector illustrated in FIGS. 1A to 1D.

As shown in FIG. 4 also, on one side of the paired signal contacts S arranged at an end in an arrangement direction of the contacts 2, i.e., in the transversal direction A1, another ground contact G' having no contacting portion is disposed as a dummy terminal. With this structure, no difference in impedance is caused among the paired signal contacts and the paired signal contacts arranged at the end have an impedance condition equivalent to that of the other paired signal contacts. Thus, more excellent electric characteristics are expected.

Figure 5:
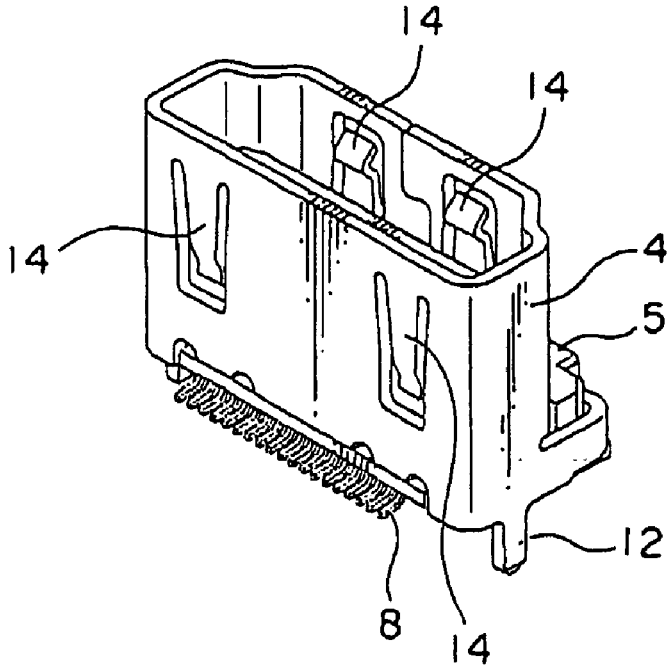
FIG. 5 is a perspective view of a connector according to another embodiment of this invention.

In the foregoing, the receptacle connector called an angle type has been described. However, this invention is similarly implemented in a receptacle connector called a straight type as illustrated in FIG. 5. In FIG. 5, those parts having similar functions are designated by like reference numerals.

While the present invention has thus far been described in connection with a few embodiments thereof, it will readily be possible for those skilled in the art to put this invention into practice in various other manners. An additional ground contact having a contacting portion and a terminal portion may be used instead of using the dummy terminal being not provided with a contacting portion. Even in such an arrangement of the contacts, only three types of the contacts are required in each row and an outer dimension or a profile of the connector need not be increased.

What is claimed is:

1. A connector to be mounted to a substrate, comprising a plurality of contacts each of which has a contacting portion to be connected to a mating connector and a terminal portion to be connected to the substrate, wherein:

the contacts includes a first contact group comprising a pair of signal contacts ,and a ground contact;

the contacting portions of the paired signal contacts are disposed in a first row with a first interval kept from one another;

the contacting portion of the ground contact is disposed in a second row parallel to the first row facing the first interval;

the terminal portions of the paired signal contacts are disposed in a third row to be adjacent to each other; and the terminal portion of the ground contact is disposed in the third row to be outside of the terminal portions of the paired signal contacts; and wherein the contacts further include a second contact group comprising a pair of signal contacts and a ground contact;

the contacting portions of the paired signal contacts in the second contact group are disposed in the second row, spaced from each other at a second interval, and adjacent to the contacting portion of the ground contact in the first contact group;

the contacting portion of the ground contact in the second contact group are disposed in the first row to be faced to the second interval;

the terminal portions of the paired signal contacts in the second contact group are disposed in the third row, adjacent to each other, and adjacent to the terminal portion of the ground contact of the first contact group; and the terminal portion of the ground contact in the second contact group being is in the third row and adjacent to one of the terminal portions of the paired signal contacts in the second contact group.

2. The connector according to claim 1, wherein the third row is parallel to the first row.

3. The connector according to claim 1, wherein the terminal portions are arranged at a pitch equal to a half of that of the contacting portions of the paired signal contacts.

4. The connector according to claim 1, wherein each of the contacts has a connecting portion connecting the contacting portion and the terminal portion, the terminal portion having a width narrower than that of the connecting portion, the terminal portions of the paired signal contacts extending from the connecting portions at positions near to one sides faced to each other, the terminal portion of the ground contact being disposed adjacent to one of the terminal portions of the paired signal contacts.

5. The connector according to claim 1, wherein the contacting portions are disposed at an equal pitch in the first and the second rows, the terminal portions being disposed at a pitch equal to a half of that of the contacting portions.

6. The connector according to claim 1, further comprising a ground contact having no contacting portion and disposed on one side of the paired signal contacts arranged at an end in an arrangement direction of the contacts.

7. The connector according to claim 1, further comprising a housing holding the contacts, the housing having a coupling portion to be coupled with the mating connector, the contacting portions being disposed in the coupling portion, the terminal portions being exposed outside the housing.

8. The connector according to claim 7, wherein the housing comprises an insulator interposed between the first row and the second row.

9. The connector according to claim 8, further comprising a conductive shell surrounding the contacting portions.

10. A connector to be mounted to a substrate, comprising:

a plurality of contacts each of which has a contacting portion to be connected to a mating connector and a terminal portion to be connected to the substrate; and a housing holding the contacts and having a coupling portion to be coupled with the mating connector;

the contacts including a plurality of pairs of signal contacts and a plurality of ground contacts;

the contacting portions being arranged in two rows in a staggered or zigzag pattern and arranged so that each pair of signal contacts and each ground contact are positioned at three vertexes of a triangle in the coupling portion, respectively;

the terminal portions being arranged to make a single row in that the ground contact is positioned outside the paired signal contacts.

11. The connector according to claim 10, further comprising a ground contact having no contacting portion and disposed on one side of the paired signal contacts arranged at an end in an arrangement direction of the contacts.

12. A connector to be mounted to a substrate, comprising:

a plurality of contacts each of which has a contacting portion to be connected to a mating connector and a terminal portion to be connected to the substrate; and a housing holding the contacts and having a coupling portion to be coupled with the mating connector;

the contacts including a plurality of pairs of signal contacts and a plurality of ground contacts;

the contacts being arranged in two rows in a staggered or zigzag pattern at the contacting portions and arranged in a single row at the terminal portions;

the contacting portions of the contacts being arranged so that the paired signal contacts and the ground contact corresponding thereto are positioned at three vertexes of a triangle and that the triangle is adjacent to a next triangle reversed in position;

the terminal portions being arranged so that:

the paired signal contacts whose contacting portions at two vertexes of the triangle are arranged in one of the two rows are disposed in the single row;

the ground contact whose contacting portion at one vertex of the triangle is arranged in the other row is disposed in the single row so as to be adjacent to the paired signal contacts;

next paired signal contacts, whose contacting portions are positioned at two vertexes of the next triangle and disposed adjacent to the ground contact, are disposed in the single row so as to be adjacent to the ground contact; and a next ground contact, whose contacting portion is positioned at one vertex of the next triangle, is disposed in the single row so as to be adjacent to the next paired signal contacts.

13. The connector according to claim 12, further comprising a ground contact having no contacting portion and disposed on one side of the paired signal contacts arranged at an end in an arrangement direction of the contacts.

* * * * *